US006982003B2

(12) United States Patent
Gueggi et al.

(10) Patent No.: US 6,982,003 B2
(45) Date of Patent: Jan. 3, 2006

(54) METHOD AND APPARATUS FOR CURTAIN COATING

(75) Inventors: Markus Gueggi, Marly (CH); Sedat Varli, Reichenburg (CH)

(73) Assignee: Dow Global Technologies Inc., Midland, MI (US)

( * ) Notice: Subject to any disclaimer, the term of this patent is extended or adjusted under 35 U.S.C. 154(b) by 74 days.

(21) Appl. No.: 10/496,996

(22) PCT Filed: Dec. 12, 2002

(86) PCT No.: PCT/US02/39994

§ 371 (c)(1),
(2), (4) Date: May 27, 2004

(87) PCT Pub. No.: WO03/049870

PCT Pub. Date: Jun. 19, 2003

(65) Prior Publication Data

US 2005/0011439 A1 Jan. 20, 2005

Related U.S. Application Data

(60) Provisional application No. 60/340,546, filed on Dec. 13, 2001.

(51) Int. Cl.
*B05C 3/02* (2006.01)

(52) U.S. Cl. ..... 118/410; 118/419; 118/325; 118/DIG. 4

(58) Field of Classification Search ..... 118/410, 118/419, 325, DIG. 4; 427/420
See application file for complete search history.

(56) References Cited

U.S. PATENT DOCUMENTS 5,763,013 A 6/1998 Devine et al. ..... 427/420
5,895,687 A 4/1999 Kondo et al. ..... 427/420
5,906,865 A 5/1999 Ellermeier et al. ..... 427/420
5,976,251 A 11/1999 Devine, III et al. ..... 118/324
6,468,592 B1 * 10/2002 Becker et al. ..... 427/420

FOREIGN PATENT DOCUMENTS

EP 0 567 071 A1 10/1993
EP 0 649 054 A 4/1995
EP 0 850 696 A 7/1998
EP 0 930 530 A2 7/1999

OTHER PUBLICATIONS

Derwent Abstract 1998–418055, JP 10 171064 A, (Fuji Photo Film Co Ltd), Jun. 26, 1998.
Derwent Abstract 2000–658840, JP 2000 254567 A, (Mitsubishi Paper Mills Ltd), Sep. 19, 2000.
Derwent Abstract 1999–245910, EP 907,103, P.M. Schweizer, et al. Apr. 7, 1999.
Derwent Abstract 1999–154792, DE19735588, I. Becker, et al. Feb. 18, 1999.
Derwent Abstract 1986–150642, DE 3443263, U. Skoda, Jun. 5, 1986.
Derwent Abstract 1996–478906, EP 740,197, M. Gueggi, et al. Oct. 30, 1996.

* cited by examiner

*Primary Examiner*—Brenda Adele Lamb

(57) ABSTRACT

An apparatus for curtain coating, particularly for high-speed curtain coating of a continuous paper web substrate (12) is provided with a hopper means (14) providing one or more liquid coating materials in the form of a free-falling curtain (16) impinging the substrate (12) at a dynamic wetting line. Edge guide elements (22, 24) are arranged on both sides supplying a wetting or auxiliary liquid. Each guide element (22, 24) has at least one contact area of its surface directed towards said curtain, which contact area has a multiplicity of grooves (32) and ribs (34) extending along the length of said edge guide elements (22, 24).

16 Claims, 4 Drawing Sheets

METHOD AND APPARATUS FOR CURTAIN COATING

This application claims the benefit of Provisional Appl. No. 60/340,546, filed Dec. 13, 2001.

FIELD OF THE INVENTION

The present invention relates to a method and apparatus for curtain coating of a continuously moving substrate with one or more simultaneously applied layers of liquid coating materials, and, more particularly to a method and apparatus for curtain coating involving a curtain edge guide for stabilizing a coating curtain.

BACKGROUND OF THE INVENTION

Mainly in the field of manufacture of photographic papers or coated films, curtain coating methods and apparatus are widely known and used. Typically a continuous web or sheets are continuously moved below a coating hopper. One or more liquid compositions are provided from a hopper arrangement in the form of a liquid curtain.

For the manufacture of photographic papers, liquid compositions are used of relatively low viscosity, generally less than about 150 cP (centipoise), most in the range from about 5 to about 100 cP.

The manufacture of photographic papers is a tremendously difficult art requiring extremely accurate control. The practical use of curtain coating provides a number of difficulties coming with a need for an extremely uniform coating on the one hand and a need for coating of substrates in form of a continuous web at high speeds on the other hand.

A number of problems associated with curtain coating have been addressed in the prior art and many proposals have been made to overcome such problems.

Besides obtaining a free-falling curtain having uniform curtain characteristics over its width perpendicular to the moving direction of the substrate, one of the most often addressed problems for coating at speeds higher than approximately 150 m/min is the displacement or deformation of the curtain by the air which is carried along the uncoated substrate due to friction. That air is carried along with the moving substrate to the coating point which designates the location where the coating liquid first contacts the substrate. In the curtain coating process this location has the form of a line across the substrate and is referred to as the dynamic wetting line. The area near the substrate where the air is in motion due to friction is called the boundary layer.

It has further been found important to stabilize the edge regions of the free falling curtain to prevent narrowing of the curtain due to surface tension of the coating liquid.

Another drawback coming with an unguided curtain is the forming of edge regions on the coated web having greater coating thickness than the remainder of the web, which is generally undesirably and provides for a need to cut off or remove the edge region of the coating layer or web and discard the same, as a uniform coating is normally required to meet the expected quality standards.

Consequently, many attempts have been made to overcome the drawbacks and improve coating performance in curtain coating of substrates.

One of the problems associated with guiding of the curtain edge is described for instance in U.S. Pat. No. 5,895,687 to Kondo et al. originating from the so called "tea-pot effect" or "tea-pot phenomena". The tea-pot phenomena may be observed with regard to a coating solution which flows down along the slide surface of the coating hopper or die, and is just about to fall from the tip of a lip of the coating hopper: the coated liquid curtain layer does not fall in the vertical direction due to a flow speed variation of the coating solution over its thickness, causing the curtain to fall while it is curved towards the hopper. Kondo et al. propose to provide an edge guide means for the coating curtain wherein the edge guide has a curved cross sectional shape preferably in the form according to the tea-pot phenomena. Although it is acknowledged in U.S. Pat. No. 5,895,687 that a conventional flat plate type edge guide stabilizes a curtain layer it is described as being disadvantageous and providing a thick edge layer formed on the coated substrate due to an increased contact area between the flat plate type edge guide and the coating liquid.

With reference to Japanese Patent Application Open to Public Inspection No. 99668/1989 it is stated that providing for side solutions flowing on the edge region of the curtain would be disadvantageous because the side solution is intensely accumulated on each end portion of the curtain, resulting in an excessively thick layer on both edges of the coated substrate.

To overcome the latter mentioned problem EP 0 740 197 A1 discloses an edge guide for a coating curtain having a dosing slot at the top and in the region of the tip of the lip of the coating hopper for providing a side flow to reduce disturbances of the free-falling coating curtain due to an inhomogeneous velocity profile over the width of the curtain. With dry edge guides a problem is reported that the falling velocity of the curtain in the edge region contacting the edge guide tends to zero because of the friction and adhesion of the curtain edge on the edge guide. Consequently, an inhomogeneous coating will be obtained on the substrate web in the region of the curtain edge and it was often proposed in the prior art to involve a coating curtain being wider than the substrate to be coated, thus, to provide coating solution in excess. Of course, such an approach is economically unattractive because a part of the coating solution is lost and the machinery is soiled and therefore needs frequent interruptions of the manufacturing process for cleaning operations.

The equipment proposed in EP 0 740 197 A1 comprises, in addition to the wetting guiding edge, a cutter and suction arrangement at the bottom of the guiding edge cutting off the outermost edge region of the curtain contaminated with a side flow, which may comprise water or a water-based composition. The outermost edge region and the side flow is removed by a suction arrangement at the bottom of the edge guide.

Further, it is known from DE 197 35 588 A1 to provide a coating curtain from a slot nozzle to an edge guide element, formed integrally with the slot nozzle arrangement but recessed, and further having an outlet for a side flow of the coating liquid at the top of the edge guide providing an additional flow of coating liquid on the surface of the edge guide. The inclination of the edge guide forms the falling curtain to become narrower at the bottom of the edge guide near the wetting line.

Further it is proposed to direct a cooling liquid through the interior of the edge guide so that the edge guide is held at a temperature of about 15° C. below the temperature of the coating liquid. This measure is proposed to prevent coating composition from solidifying on the surface of the edge guide. The edge region of the curtain is cut off by a cutter means and drained away. In one embodiment it is proposed to curve a surface of a cutter means being in contact with the remaining curtain parts to expand the curtain downwards of the cutting means to prevent formation of edge regions on the coated substrate having a thickness different from the remainder of the coated substrate.

The disclosure of U.S. Pat. No. 5,763,013 to Devine et al. addresses the problem that the earlier proposed arrangement for removing the edge region of the curtain by cutting means and a vacuum source for sucking off the cutting off edge portion liquid provides further problems with respect to the reliability of the manufacturing process due to solidification causing at least partial plugging of the vacuum channels. This is reported to cause particular problems if the coating composition includes a setting polymer such as bone gelatin and the contact surfaces of the vacuum means have temperatures below ambient temperatures. Devine proposes providing an additional flushing liquid directly to the vacuum means so that the liquid from the edge region of the curtain will reliably be drained from the cutting means.

EP 0 907 103 A1 proposes to provide a curtain edge guiding means comprising a porous layer and lubricant liquid supply means arranged in connection with a porous layer so that the lubrication liquid is provided over nearly the full length of the edge guiding means. More particularly, it is proposed to supply the liquid along the guiding edge at a velocity which is the same as the falling velocity of the curtain at the respective location along the guiding edge. The bottom region of the guiding edge is proposed to comprise a solid material easily wetted having a surface inclined towards the curtain edge by 1° to 5° towards the center of the curtain and having a suction slot at the outermost bottom having a collecting edge protruding over the surface towards the curtain to ease removal of the lubrication liquid and outermost edge parts of the coating curtain.

U.S. Pat. No. 5,906,865 to Ellermeier et al. reports breakage of the coating curtain as the predominant limiting factor with respect to coating speed and continuous operation of a curtain coater. Wetting of edge guides or curtain holders with an auxiliary liquid is reported to be the most proposed measure to overcome the problems originating from turbulence in the proximity of the curtain edge. Separating devices or cutting means often proposed comprise essentially a flat cantilevered blade. This blade projects from a vacuum housing and interrupts the free fall of the curtain in the immediate vicinity of and parallel to the substrate to be coated. The interruption occurs just before the curtain lands. The blades need to be thin and sharp. According to a number of proposals it is further rinsed on its upper side by cleaning liquid. The stream of cleaning liquid rinses the liquid of the curtain edges out of the coating area. If the curtain edges comprise a gelatin solution, only part of the valuable coating solution is lost but crust may accumulate on the edge of the blade during long operation cycles. This is caused by gelatin residues. Thus, the blade becomes dull. A dull blade cannot satisfactorily prevent a beaded coating on the edge. One of the problems coming with the blade is a flow adhering to the surface of the blade or its underside, generally being unstable. Fundamentally, the cantilevered, sharp edged blade presents an ever-present risk to the operators. Cleaning of the blades can result in injuries and the thin blades can be easily bent and damaged causing interruptions in the coating process both to required cleaning and repair operations.

U.S. Pat. No. 5,906,865 proposes cutting the edge region of the curtain together with a wetting liquid used on a preferably flat edge guide to be cut off by a free jet of a separating liquid, like water, and to drain off the cut edge region of the curtain and any auxiliary liquid used on the edge guide by strong vacuum source before the curtain reaches the substrate to be coated. It is pointed out that there is no wear on the jet cutting means and no risk for personnel working when the coating process is interrupted.

According to EP 0 567 071 A1 a curtain coating method wing a slide hopper includes the supply of an auxiliary liquid in order to eliminate the unevenness of coating thickness produced in both edge portions of a coating film which is formed by causing a free-falling coating film to impinge on a web running continuously. The auxiliary liquid is poured from a position on a distance of no more than 10 mm from a boundary line between guide blades and edge guides in a direction of the guide plates. The quantity of flow of the auxiliary liquid to be poured onto each of the guide blades is not more than 10 cc/min. A guide blade according to this prior art has an inclination of an angle $\Theta=10°$ to 80° with respect to a slide plane in order to pour an auxiliary liquid to the side of the coating film on a slide surface. The surface tension of the auxiliary liquid is higher than that of the coating film so that the auxiliary liquid is not attracted to the center of a coating film to thereby make film coating unstable. According to one example of this document the auxiliary liquid has a 2 cP (centipoise) viscosity, 37 dyne/cm surface tension and 4 cc/min supplied quantity. The auxiliary liquid is poured to the upper surface of the guide blade at a position which is at a distance of no more than 10 mm in the direction from boundary line between the guide blade and the edge guide.

According to EP 0 649 054 A1 a stripe internal edging method and apparatus is disclosed for curtain coating of a support with one or more layers of the liquid coating composition using stripes of the liquid coating composition formed at the edges of the free-falling curtain, the stripes being guided by edge guides which are positioned so that there is an uncoated margin of support at each edge of the support. Liquid is removed from the edges of the free-falling curtain near the point of impingement on the support. The apparatus and method is used especially for curtain coating of very low flow rates per unit width. The apparatus comprises flushing means for issuing liquid from the edge guide to maintain wetting contact with the stripes. The stripe composition is generally an aqueous gelatin solution with appropriate surfactants added to balance the surface tension of the stripe with a top on bottom layers of the curtain. Thickeners may also be used. Stripe viscosity is optimally in the range of 1 to 30 cP (centipoise), especially 5 to 20 cP. The flow rate of the stripe is greater than the minimum possible to achieve a stable curtain along the edge guides. The width of the stripe is at least 3 to 10 mm. A stripe air interface of at least 5 mm is formed before the stripe merges with the main body of the curtain. The stripe is formed by means of a cavity and slot arrangement in which the stripe flows down inclined surfaces before merging with the main body of the curtain. Means for forming the stripe may be located on the hopper edge pad. Such a pad may be manufactured incorporating an inlet and downwardly directed metering slot for forming the stripe. The metering slot discharges the stripe composition at or near the lip of the hopper. Also the stripe may be guided down the edge guide by lubricating fluid introduced through outlet and slide. The stripe fluid is provided through a conduit and the lubricating fluid which is preferably water is provided through another conduit. The flow rate of the stripes is especially approximately 1.6 cc/cm sec and the stripe viscosity is 8 cP. The surfaces of the stripe should be edged before merging with the main body of the curtain as otherwise the interface between the stripe and the main body of the curtain departs significantly from vertical as the stripe flow rate is increased.

EP 0 850 696 A2 relates to a curtain coating method using an auxiliary solution to stabilize the curtain. The auxiliary solution is to flow down along edge guides at a flow rate between 0.3 cc/min and 3.0 cc/min from each side of solution injecting means. The value of surface tension of the auxiliary solution is greater than or the same as the minimum value of surface tension of the coating solution to restrict the mixture of the auxiliary solution and the coating solution to the minimum. Viscosity of the auxiliary solution is smaller than that of the coating solution. The auxiliary solution is either a gelatin solution of no more than 3 percent by weight or water. The apparatus comprises slide plates having solution injection outlets supplying the auxiliary solution which flows down to a boundary in the vicinity of the side plates. A flow rate of the auxiliary solution increased up to 3 cc/min makes the force of the curtain shrink smaller gradually, but when the amount of the auxiliary solution exceeded 3 cc/min the change on the curtain disappeared, simply showing the thickened water layer of the auxiliary solution. It is stated in EP 0 850 696 A2 that the more an injecting outlet for the auxiliary solution is located at the downstream side of a curtain the less is any effect, if the injecting outlet is located at a lip which is at the upstream side of the curtain or at a position above that the effect is greater, and where the height for supplying is the same as the coating solution height the effect is at a maximum. Excellent coating with fewer uneven portions can be conducted using an auxiliary solution having a gelatin concentration of no more than 3 percent, or water.

According to EP 0 930 530 A2 a curtain coating method and apparatus for coating at high speed without unevenness to form uniform coatings in multi-layer coating comprises a center line of outlets for discharging auxiliary solution being sloped to the direction in which the coating solution flows down. An angle between the centerline of the outlets and a horizontal line is within 30 degrees. The outlets have a circular diametrical section of 0.4 to 1.5 mm in diameter. The amount of auxiliary solution discharged from each outlet is 3 to 8 cc/min. A pair of outlets for discharging the auxiliary solution is disposed in the position along each edge part of free-falling curtain and at a fixed distance downward from a hopper lip. The fixed distance is between 0.1 and 1.5 mm. A pressure of the auxiliary solution supply is applied in the width direction of the free-falling curtain. As an auxiliary solution water may be used or water and methanol or a solution comprising water, methanol and gelatin.

U.S. Pat. No. 5,976,251 discloses edge guides for curtain coating apparatus and delivering devices and lubricating liquid for use with curtain coating apparatus. A dual wire edge guide is supplied with lubricating liquid without creating a stationary wave in the curtain coating avoiding non-uniformities. Lubricating and flushing liquid is supplied through a straight horizontal conduit of constant cross sectional area with an axis lying in a plane parallel to that of the curtain. The outlet of the conduit is in nominal contact with the dual wires. The breadth of the outlet is from about 2 to 4 mm. A land is provided surrounding the outlet for lubricating liquid lying substantially in a vertical plane perpendicular to a hopper lip, tapering downwards and terminating from about one centimeter of the hopper lip. The flow rate of the lubricating liquid may vary between 0.3 and 0.5 cc/sec and the lubricating liquid can be water or a solvent for the coating composition.

Although many approaches have been made in the prior art to overcome the drawbacks and problems coming with the use of a curtain coating process, in particular at high coating speeds, there are still remaining drawbacks effecting the quality and cost effectiveness of curtain coating methods, in particular with respect to high speed curtain coating of continuous paper web substrate.

SUMMARY OF THE INVENTION

It is therefore an object of the invention to provide an apparatus for curtain coating, particularly for high-speed curtain coating of a continuous paper web substrate, with a hopper arrangement providing one or more liquid coating materials in the form of a free-falling curtain impinging substrate at a dynamic wetting line wherein edge guide elements on both sides are arranged and wherein each element has at least one contact area of its surface directed towards said curtain, which contact area has a multiplicity of grooves and ribs extending along the length of said edge guide elements.

Briefly stated, these and other features, objects and advantages are obtained by providing a method for curtain coating of a moving substrate like a paper web wherein a substrate moves below a hopper arrangement providing one or more liquid coating materials in the form of a free-falling curtain impinging the substrate at a dynamic wetting line wherein improved edge guide elements are used for preventing the formation of stationary waves within the coating curtain and allowing disturbance free provision of an auxiliary liquid as well as practically complete removal of the auxiliary liquid whilst preventing the fouling of the edge guides. Further improvements obtained by the side and curtain edge guides according to the invention are increased falling velocity on the curtain edge guide, the prevention of wetting disturbances in the edge region of the coating film air entrainment, prevention from forming of coating film irregularities caused by the Marangoni-effect (a gradient of surface tension from low to high displaces the materials) and reducing of the Teapot-effect (a curved trajectory of the liquid curtain which may deviate substantially from the vertical trajectory) with respect to the edge guide in multi-layer coating.

In a preferred embodiment of the invention, each edge guide for a curtain coater has at least one contact area of its surface directed towards a coating curtain, which contact area has a multiplicity of grooves and ribs extending along the length of the edge guide to improve wetting performance.

With the grooves and ribs the coating curtain can be held more even and can be held better in a straight and direct line over the width of the curtain in cross direction of moving web without making a wave-like movement.

More preferably, the ribbed area is at least 10 mm wide, and/or the grooves are located at a distance of about 0.5 mm from each other, whilst the top surface of the ribs are located at a distance of about 0.5 mm from each other. Preferably, the essential parts of the surfaces forming a groove are inclined to each other at an angle of about 90 degrees.

In preferred embodiments protrusions are arranged adjacent to the ribbed contact area on both sides transverse to the length of the edge guide, and further protruding surface areas are arranged on the protrusions which protruding surface areas are essentially polished. The polished protruding surface areas limit the wetting area for an auxiliary liquid and/or prevent the protruding surface areas from being wetted by either liquid, therefore reducing the risk of spills and, thus, disturbances of the coating curtain.

In another preferred embodiment the edge guide has a suction opening, preferably of slot or recess configuration, as near as possible to the bottom end of the edge guide and smoothly integrated into the contact area for removing of the wetting or auxiliary fluid, preferably located at the bottom end in close proximity to the substrate web.

In a further preferred embodiment each of the edge guide elements is designed to be made in one piece with the edge guide of a hopper slide of a curtain coater such that the surfaces of either edge guides being designed to be in contact with the coating film and/or any auxiliary liquid fit together generally without projections or recesses disturbing the flow of the coating film and/or the auxiliary liquid causing turbulences in the fluids, respectively.

DETAILED DESCRIPTION OF THE INVENTION

Figure 1:
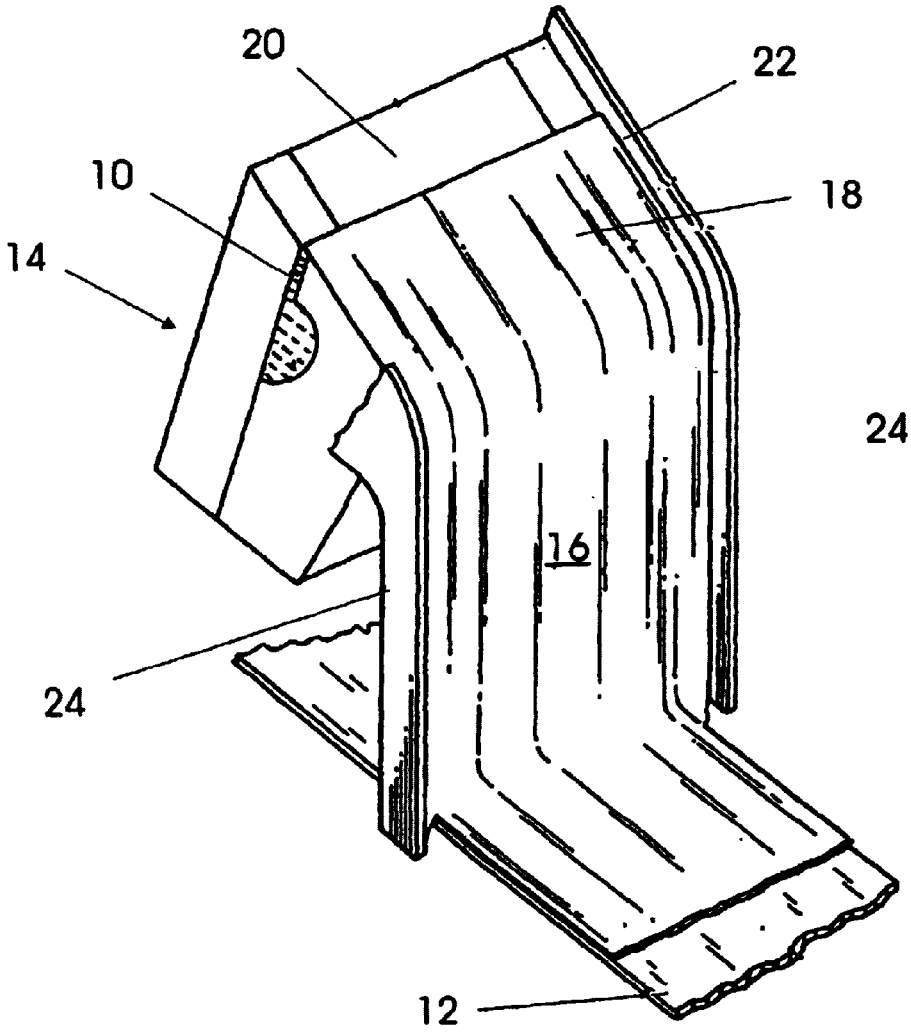
Fig. 1 (PRIOR ART)
FIG. 1 is a schematic overview showing generally a curtain coater arrangement as known from the prior art.

FIG. 1 shows the main parts of a curtain coater as known from the prior art and generally involved with an improved method and apparatus according to this invention. A conventional curtain coater has means, preferably in form of a backing roller (not shown), for forwarding separate sheets or a continuous web 12 as a substrate to be coated. The web 12, which may comprise a paper, is forwarded along the backing roller through the curtain coater.

A hopper means 14 is located generally above the backing roller. Various forms of hopper means 14 are known, generally providing a curtain 16 of a coating liquid 18 free falling over a distance forwarded over a lid or any other suitable means. The coating curtain 16 is moved towards the substrate 12 by gravity force and impinging on the substrate web 12 along a line generally perpendicular to the moving direction of the substrate 12. The line is generally below the lid but moving relatively to the substrate web 12 when in motion and therefore called the dynamic wetting line.

The coating film 18, which may comprise several different layers of liquid, is provided through one, or more in case of a multi-layer coating film 18, slot type openings 10 onto a so called slide 20 of the coating hopper 14.

For the purpose of this application, the area of the coating film 18 orientated in a direction towards the substrate web 12 is called downstream, whilst the coating film 18 towards the slot 10 is called upstream.

The slide width is limited by slide edge guides 22 which generally provide for the width of the coating film 18. Downstream of the slide edge guide 22 and generally along the distance where the coating curtain is free falling, curtain edge guides 24 are provided to hold the coating curtain 16 until it impinges on the substrate web 12.

Figure 2:
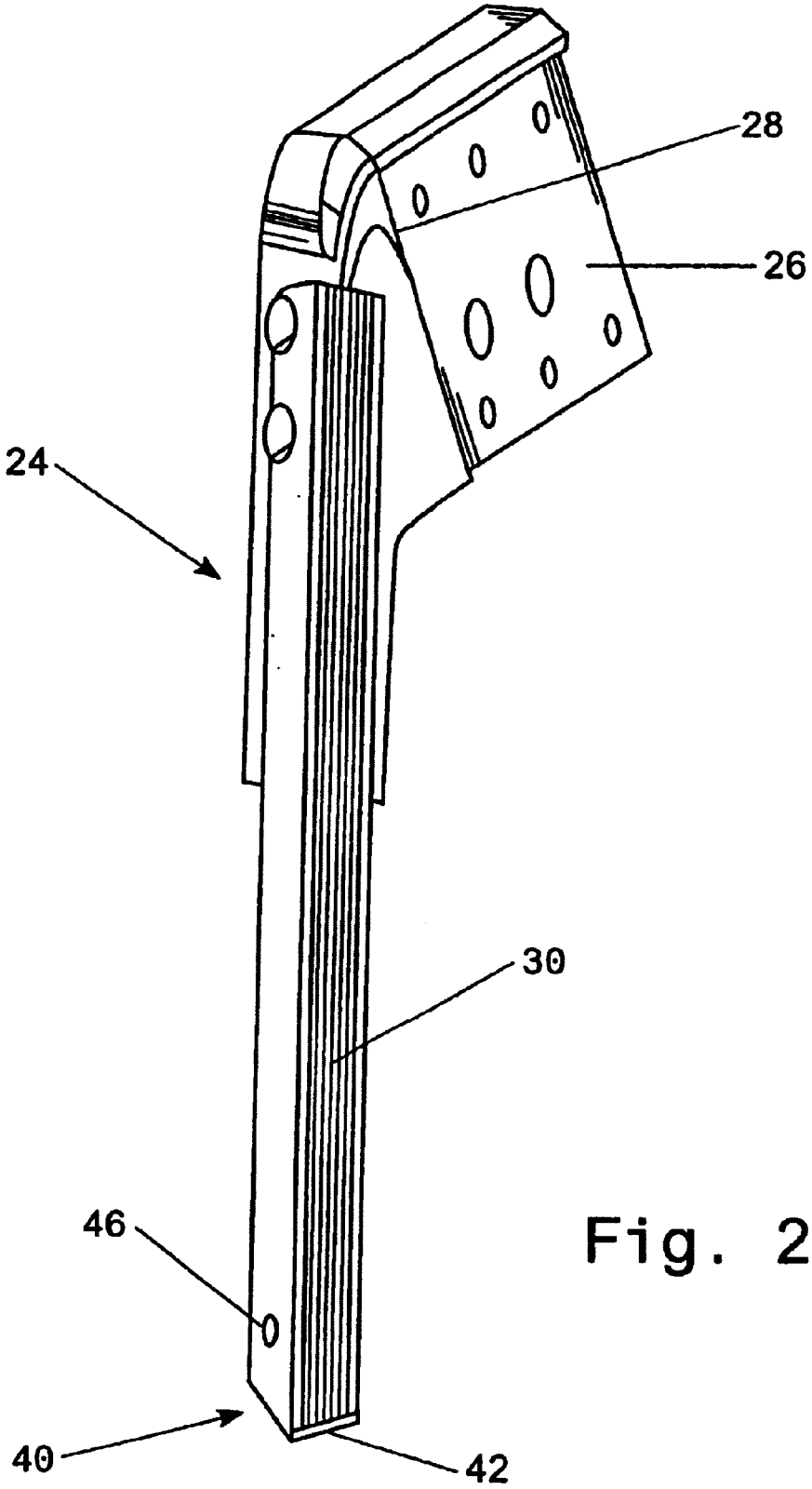
FIG. 2 is a perspective view of a curtain coater edge guide arrangement for the coating curtain.

Turning to FIG. 2, a curtain edge guide 24 comprises a mounting part 26 for smoothly fitting to corresponding slide edge guide 22. Preferably, the contact region depicted by 28 is formed to smoothly fit with the hopper slide edge guide 22 such that the surfaces of either edge guides 22 and 24 form a planar junction without projections or recesses disturbing the flow of the coating film and/or any auxiliary liquid so that any turbulence in the fluids is prevented which could provide for streaks or the like in the coating on the web 12.

Figure 6:
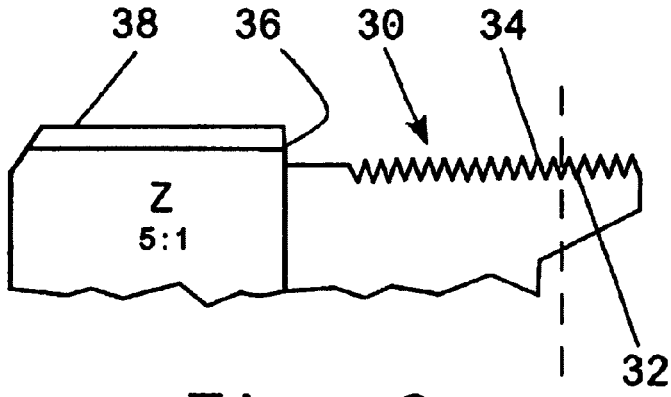
FIG. 6 is an enlarged view of FIG. 4 according to X illustrating the nature of the ribbed contact area.

Any recess provided in the slide edge guide 22 and/or the curtain edge guide 24 for providing an auxiliary liquid between the edge guides 22 and 24 and the coating film 18 run into a ribbed contact area 30 of the edge guide 24. The ribbed contact area 30 has a multiplicity of grooves 32 and ribs 34 as can be seen from the enlarged view in FIG. 6, arranged along the curtain edge guide 24. The contact area 30 provides for guiding and holding the coating curtain 16 whilst free falling towards the substrate 12 and thus to keep the curtain 16 as uniform as possible.

Figure 3:
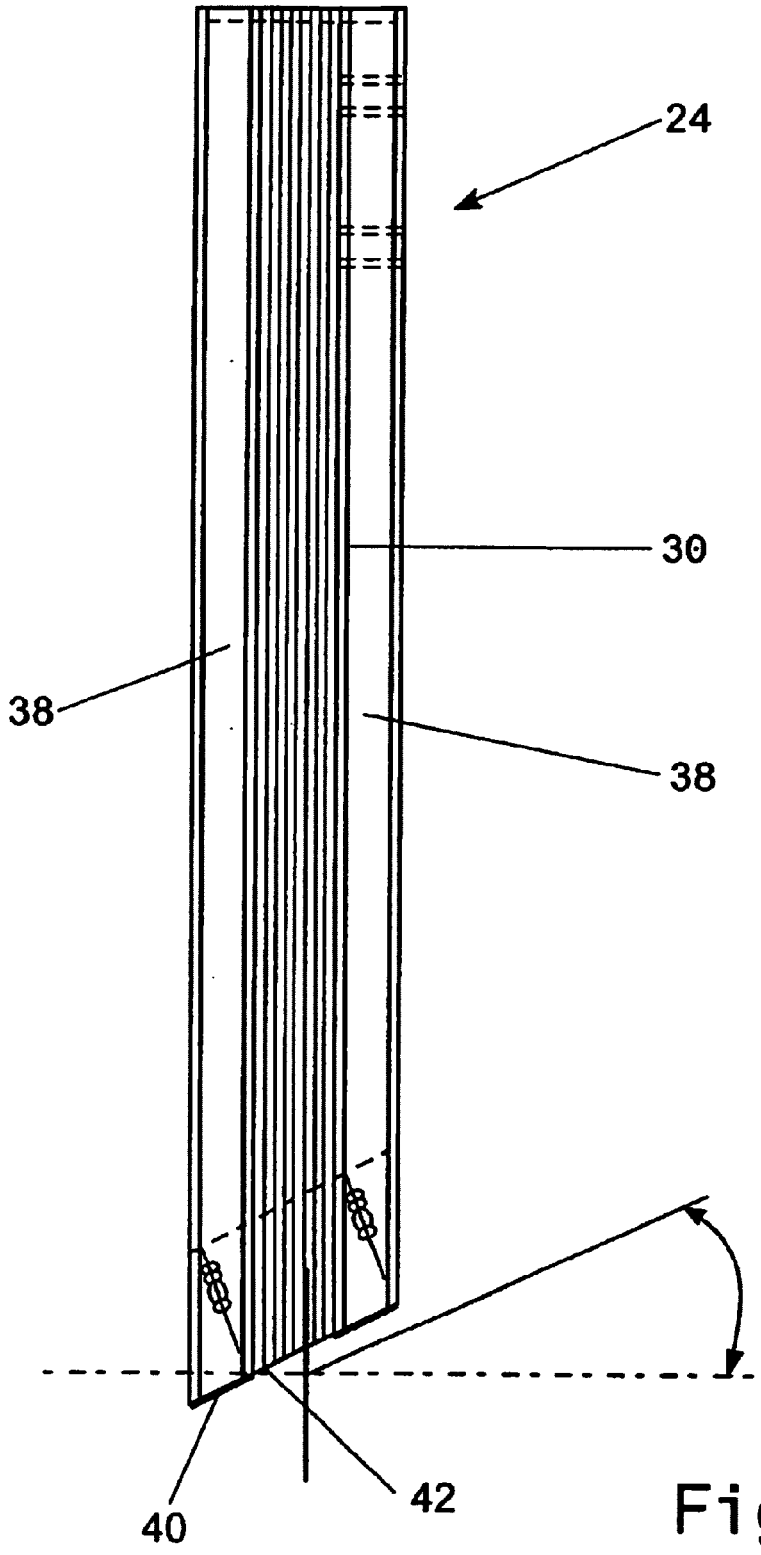
FIG. 3 is a partial side view of the edge guide of FIG. 2 viewed onto the ribbed area side.

The bottom end 40 of the curtain edge guide 24 may be formed at an angle other than perpendicular with respect to the longitudinal extension of the curtain edge guide 24, as depicted in FIG. 3, to meet the surface of a substrate web 12 where the continuous web 12 is inclined to the horizontal in the region of the dynamic wetting line.

In a preferred embodiment, the ribbed area 30 is at least 10 mm wide, more preferably about 12 mm wide. It has been found that an arrangement having grooves 32 located at a distance of about 0.5 mm from each other and a top surface of the ribs 34, located at a distance of about 0.5 mm from each other provide an excellent wetting performance so that any speed difference between the curtain edge guided by the edge guide 24 and the center of the curtain 16 is minimized, and thus, coating quality is improved. It was further found that arranging the essential parts of the surfaces forming a groove 32 at an angle of about 90 degrees to each other showed excellent performance.

Protrusions 36 are arranged adjacent to the ribbed contact area 30 for limiting the wetting area of the coating liquid or any auxiliary liquid to the contact area 30. Preferably, protruding surface area 38 on the protrusions 36 are polished to shine for preventing the surface area 38 being wetted by either an auxiliary or coating liquid 18, therefore reducing the risk of spills which may cause impacts in the coating curtain 16, and thus, streaks in the coated web 12.

Figure 4:
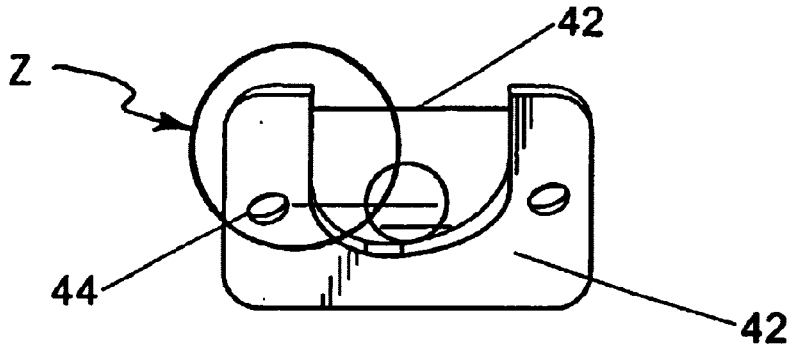
FIG. 4 is a bottom view of the edge guide depicting the suction opening.
Figure 5:
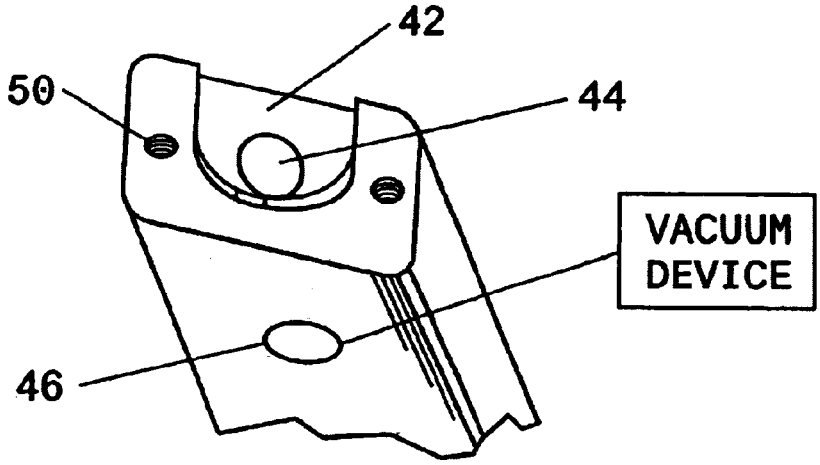
FIG. 5 is a perspective partial view of the bottom end of the edge guide as shown in FIG. 4.

At the bottommost end 40 of the curtain edge guide 24 as shown in FIGS. 4 and 5 is arranged a recess 42 for forming a suction slot connected to a channel 44 having an opening 46 for connecting to a vacuum device 60 for removal of any auxiliary liquid running down the contact area 30.

The suction slot or recess 42 extends over the full width of the contact area 30. For optimum coating performance the suction opening 42 is located in close proximity to the substrate web 12. The suction recess 42 is smoothly integrated into the contact area 30 without any protrusions or recesses or the like to remove the auxiliary liquid nearly completely. Threaded holes 50 may be provided for mounting of a cover plate for forming the suction slot 42 with an opening of about 0.1 to about 1 mm.

Where this invention has been described in terms of a preferred embodiment, the present invention can be further modified within the spirit and the scope of this disclosure. This application is therefore intended to cover any variations, uses or adaptations of the invention using its general principles. Further, this application is intended to cover such departures from the present disclosure as come within known or customary practice in the art to which this invention pertains and which fall within the limits of any claims directed to this invention.

What is claimed is:

1. An apparatus for curtain coating, particularly for high-speed curtain coating of a continuous paper web substrate, comprising a hopper means providing one or more liquid coating materials in the form of a free-falling curtain impinging the substrate at a dynamic wetting line and edge guide elements on both sides of said curtain are arranged supplying a wetting or auxiliary liquid and wherein each element has a length along its longitudinal axis extending in a direction of flow of said curtain from said hopper means and at, least one contact area directed towards and in contact with said curtain, said contact area having a multiplicity of grooves and ribs extending along the length of said edge guide elements thereby forming a ribbed contact area.

2. The apparatus according to claim 1, wherein said edge guide elements further comprise protrusions, said protrusions being arranged adjacent and on both longitudinally extending sides of to the ribbed contact area.

3. The apparatus according to claim 2, wherein protruding surface areas are arranged on said protrusions and wherein said protruding surface areas are polished.

4. The apparatus according to claim 1, wherein said edge guide elements have a bottom end and said edge guide elements have suction openings in the area of the bottom end of said edge guide elements for removing the wetting or auxiliary liquid.

5. The apparatus according to claim 4, wherein each suction opening is arranged as a recess for forming a suction slot connected to a channel having an opening for connecting to a vacuum device for removal of any auxiliary liquid running down said contact area.

6. The apparatus according to claim 5, wherein the recess extends over the full width of the contact area.

7. The apparatus according to claim 6, wherein the recess or suction opening is located in close proximity to the substrate web.

8. The apparatus according to claim 5, wherein the recess is smoothly integrated into the contact area without any protrusions or recesses.

9. The apparatus according to claim 5, wherein threaded holes are provided in each edge guide means for mounting of a cover plate for defining a discrete slot opening between the edge guide means and the cover plate.

10. The apparatus according to claim 9, wherein said discrete slot opening has a size of about 0.1 to about 1 mm.

11. The apparatus according to claim 1, wherein each of said edge guide elements is designed to be made in one piece with an edge guide of said hopper means, and wherein each said edge guide element and said edge guide fit together generally without projections or recesses which would turbulently disturb the flow of the coating and/or the wetting liquid.

12. The apparatus according to claim 1, wherein the ribbed area is at 10 mm wide, and/or the grooves are located at a distance of about 0.5 mm from each other.

13. The apparatus according to claim 12, wherein the ribs have top surfaces and the top surfaces of the ribs are located at a distance of about 0.5 mm from each other.

14. The apparatus according to claim 12, wherein the ribbed area is at least about 12 mm wide.

15. The apparatus according to claim 1, wherein surfaces forming each said groove are inclined to each other at an angle of about 90 degrees.

16. The apparatus according to claim 1, wherein each edge guide means has a bottom end and wherein the bottom end of each edge guide means is formed at an angle other than perpendicular with respect to the longitudinal axis of the edge guide elements.

* * * * *